US008910983B1

(12) United States Patent
Neff

(10) Patent No.: US 8,910,983 B1
(45) Date of Patent: Dec. 16, 2014

(54) SLIDE FASTENER EXTENSION TETHER DEVICE AND METHOD

(71) Applicant: Edsel Neff, Rosewell, NM (US)

(72) Inventor: Edsel Neff, Rosewell, NM (US)

( * ) Notice: Subject to any disclaimer, the term of this patent is extended or adjusted under 35 U.S.C. 154(b) by 0 days.

(21) Appl. No.: 13/942,948

(22) Filed: Jul. 16, 2013

(51) Int. Cl.
*A44B 19/00* (2006.01)
*A44B 19/26* (2006.01)
*A47G 25/90* (2006.01)

(52) U.S. Cl.
CPC ..... *A47G 25/902* (2013.01)
USPC ..... 294/3.6; 24/429; 24/430

(58) Field of Classification Search
CPC ..... A44B 19/00; A44B 19/10; A44B 19/18; A44B 19/26; A44B 19/30; A44B 6/00; B21F 45/18; A47G 25/90
USPC ..... 294/3.6, 25, 26; 223/111; 24/429, 415, 24/418, 419, 420, 430; D11/221; 70/68
See application file for complete search history.

(56) References Cited

U.S. PATENT DOCUMENTS

D151,101 S * 9/1948 Taber ..... D8/54
3,006,051 A * 10/1961 Maeder ..... 294/3.6
3,249,977 A 5/1966 Cloud, Sr.
3,283,381 A 11/1966 Hurst
3,348,870 A 10/1967 Zern
D238,630 S * 2/1976 Ammons ..... D11/221
D246,293 S * 11/1977 Doughty ..... D11/4
D296,882 S 7/1988 Lopez
5,558,377 A * 9/1996 Blum et al. ..... 294/210
5,603,542 A 2/1997 Walker
5,855,401 A * 1/1999 Papernik ..... 294/3.6
D415,061 S * 10/1999 Lamacchia et al. ..... D11/221
5,975,386 A 11/1999 Fernicola
6,032,996 A * 3/2000 Kogen ..... 294/3.6
D694,152 S * 11/2013 Grettenberger ..... D11/221
D696,154 S * 12/2013 McGinnis ..... D11/221

* cited by examiner

*Primary Examiner* — Paul T Chin

(57) ABSTRACT

A slide fastener extension tether device facilitates manipulation of a slide fastener on a rear side of a garment. The device includes a cord having a first end and a second end. A first clip is coupled to the first end of the cord. The first clip is configured for coupling to a garment in a position reachable by a person wearing the garment. A second clip is coupled to the second end of the cord. The second clip has a pair of biased jaws wherein the second clip is configured for engaging a slider of a slide fastener such that pulling on the cord urges the slider to move along opposed sides the slide fastener wherein the slide fastener is selectively openable and closable by manipulation of the cord.

9 Claims, 6 Drawing Sheets

SLIDE FASTENER EXTENSION TETHER DEVICE AND METHOD

BACKGROUND OF THE DISCLOSURE

Field of the Disclosure

The disclosure relates to tether devices and more particularly pertains to a new tether device for facilitating manipulation of a slide fastener on a rear side of a garment.

SUMMARY OF THE DISCLOSURE

An embodiment of the disclosure meets the needs presented above by generally comprising a cord having a first end and a second end. A first clip is coupled to the first end of the cord. The first clip is configured for coupling to a garment in a position reachable by a person wearing the garment. A second clip is coupled to the second end of the cord. The second clip has a pair of biased jaws wherein the second clip is configured for engaging a slider of a slide fastener such that pulling on the cord urges the slider to move along opposed sides the slide fastener wherein the slide fastener is selectively openable and closable by manipulation of the cord.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
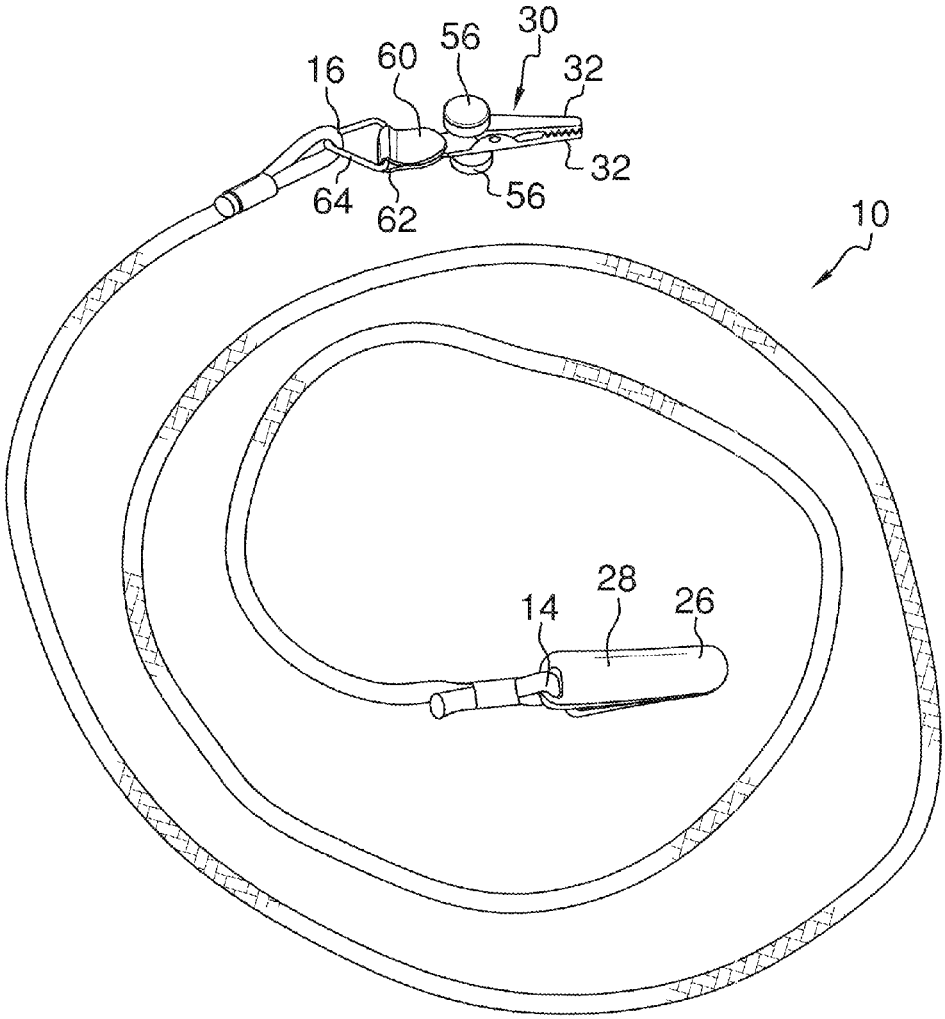
FIG. 1 is a top front side perspective view of a slide fastener extension tether device and method according to an embodiment of the disclosure.
Figure 2:
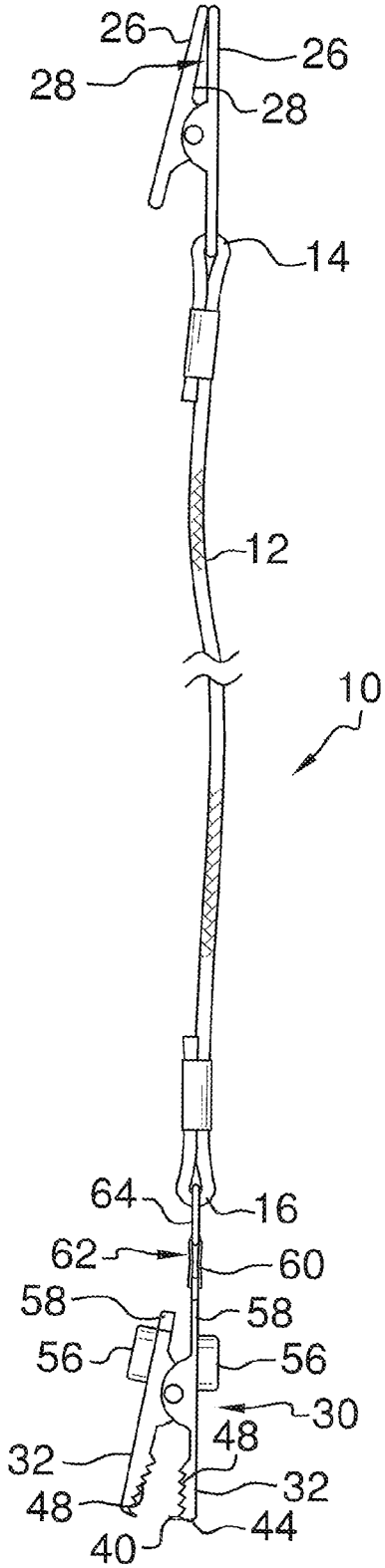
FIG. 2 is a side view of an embodiment of the disclosure.
Figure 3:
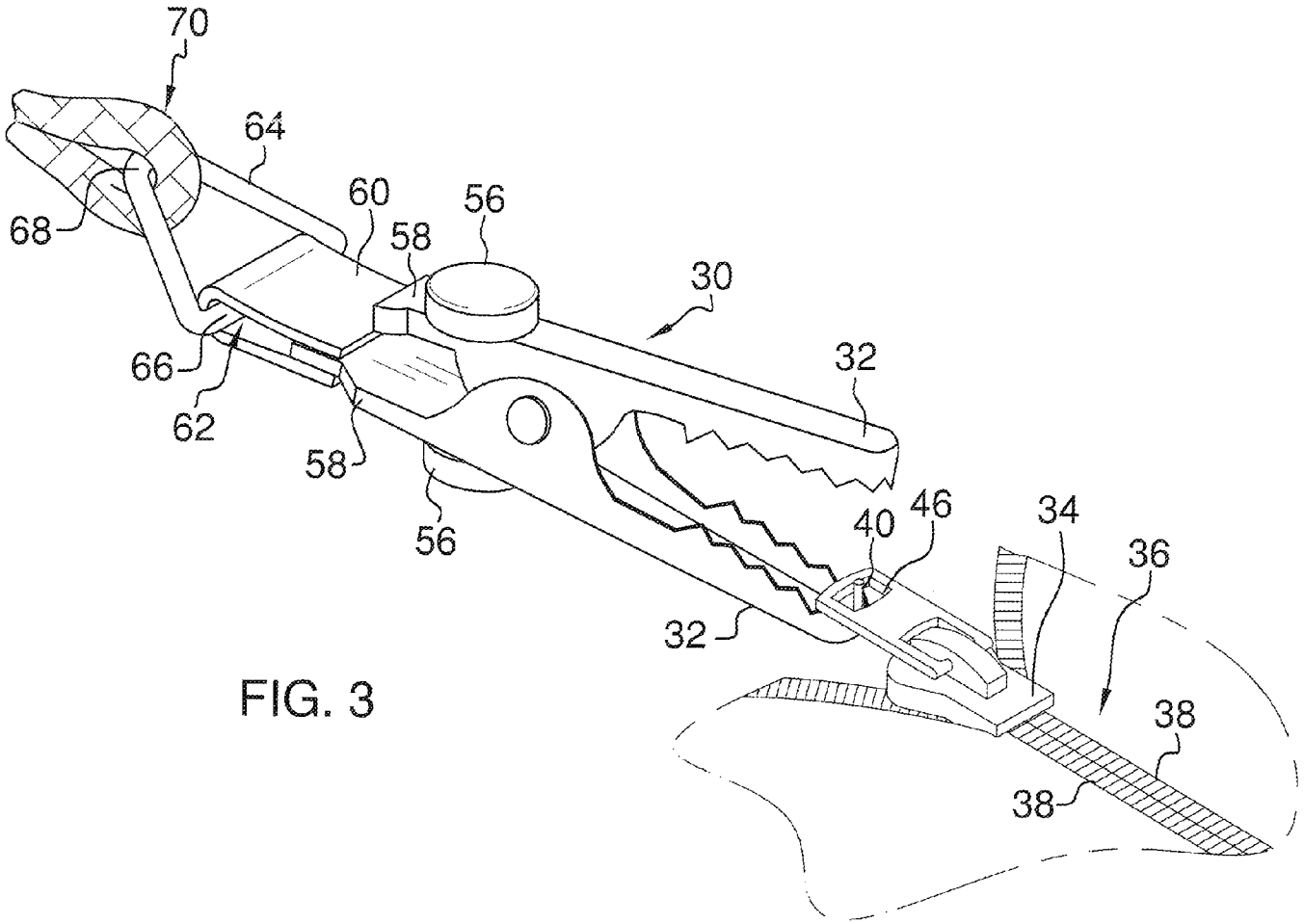
FIG. 3 is a top front side detailed view of an embodiment of the disclosure.
Figure 4:
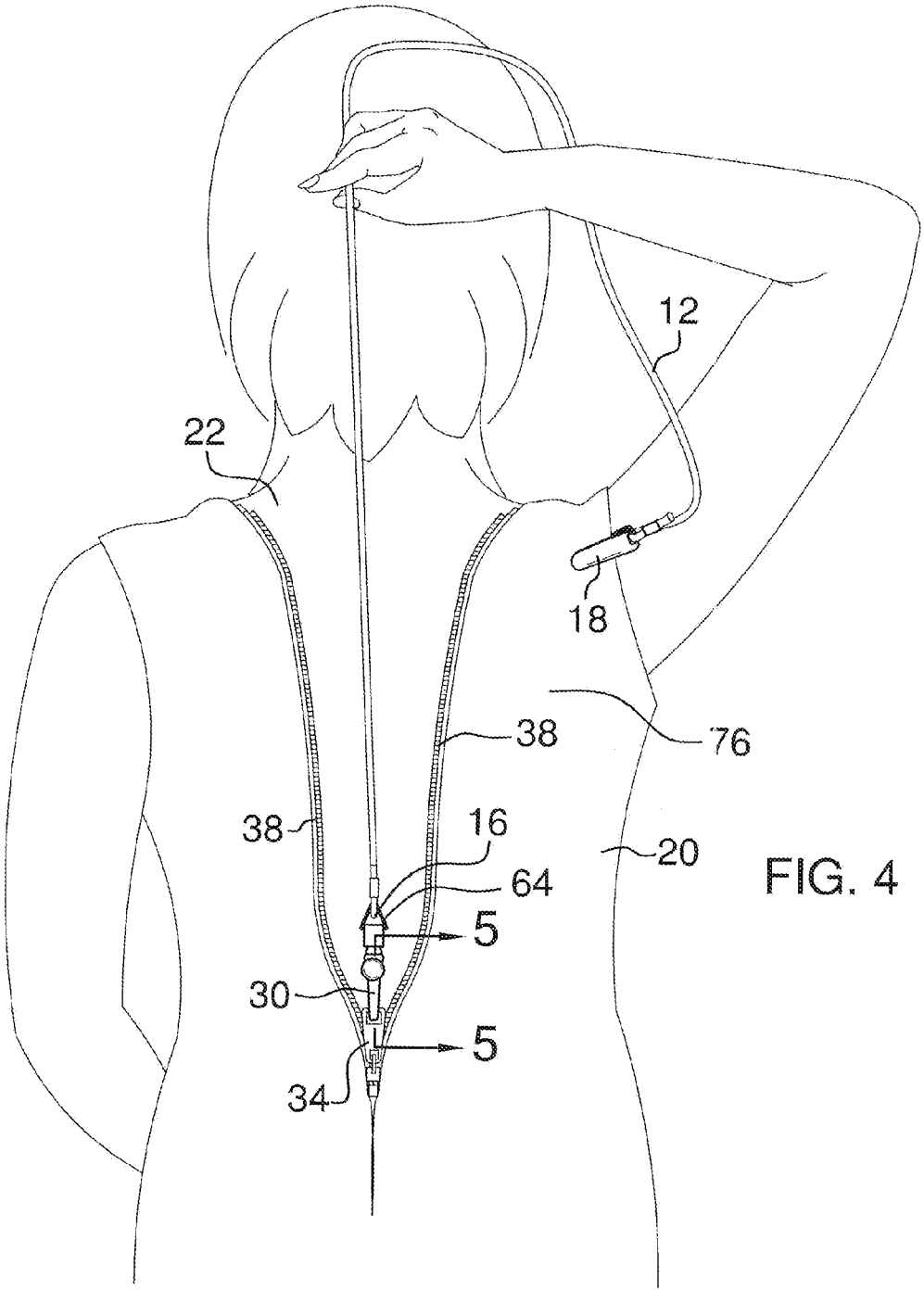
FIG. 4 is a back view of an embodiment of the disclosure in use.
Figure 5:
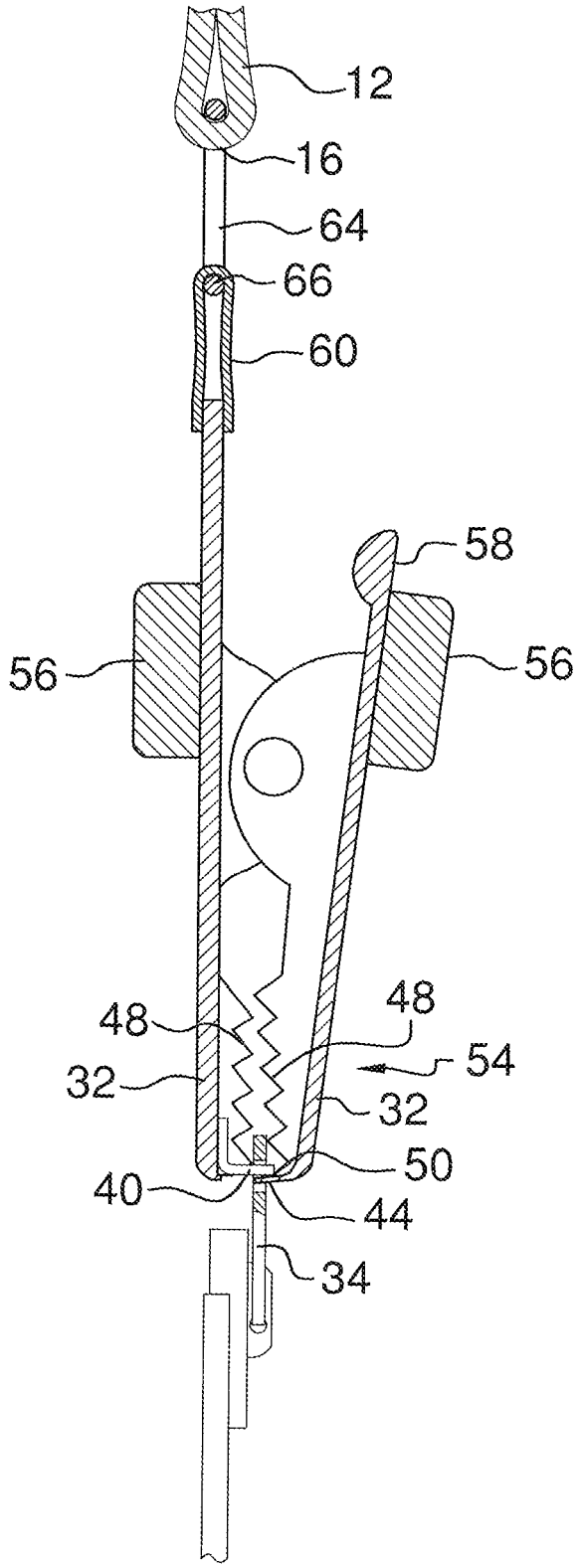
FIG. 5 is a cross-sectional view of an embodiment of the disclosure taken along line 5-5 of FIG. 4.

With reference now to the drawings, and in particular to FIGS. 1 through 5 thereof, a new tether device embodying the principles and concepts of an embodiment of the disclosure and generally designated by the reference numeral 10 will be described.

As best illustrated in FIGS. 1 through 5, the slide fastener extension tether device and method 10 generally comprises a cord 12 having a first end 14 and a second end 16. A first clip 18 is coupled to the first end 14 of the cord 12. The first clip 18 is configured for coupling to a garment 20 in a position reachable by a person 22 wearing the garment 20. The first clip 18 has a pair of biased jaws 26 which may have smooth opposed surfaces 28 to engage but not damage the garment 20. The first clip 18 may be constructed of plastic or the like to further prevent damage to the garment 20. A second clip 30 may be constructed of metal. The second clip 30 is coupled to the second end 16 of the cord 12. The second clip 30 has a pair of biased jaws 32 wherein the second clip 30 is configured for engaging a slider 34 of a slide fastener 36 such that pulling on the cord 12 urges the slider 34 to move along opposed sides 38 the slide fastener 36 wherein the slide fastener 36 is selectively openable and closable by manipulation of the cord 12.

A stem 40 may extend from a distal end 44 of a first one of the biased jaws 32 of the second clip 30 relative to the cord 12. The stem 40 extends towards a second one of the biased jaws 32 of the second clip 30 wherein the stem 40 is configured for insertion through an aperture 46 in the slider 34 wherein the second clip 30 is engaged to the slider 34. A plurality of opposed teeth 48 may be coupled to the pair of biased jaws 32 of the second clip 30. The stem 40 may overlap an inward face 50 of a distal one of the teeth 48 relative to the cord 12 when the biased pair of jaws 32 of the second clip 30 are in a closed position 54.

Each of a pair of grips 56 is coupled to an associated one of a pair of tabs 58 extending rearwardly from the pair of biased jaws 32 of the second clip 30. Each of the grips 56 may be substantially disc-shaped and constructed of a materiel to facilitate manipulation of the tabs 58 to selectively open the jaws 32. A connector 60 may be coupled to and extend from the second clip 30. The connector 60 has a straight channel 62 extending laterally relative to the second clip 30. A swivel 64 may be coupled between the second end 16 of the cord 12 and the second clip 30. The swivel 64 may be substantially triangular having a straight side 66 extending through the channel 62 of the connector 60. The swivel 64 may further have a point 68 opposite the straight side 66 extending through the channel 62. The point 68 may be coupled to a loop 70 positioned at the second end 16 of the cord 12.

Figure 6:
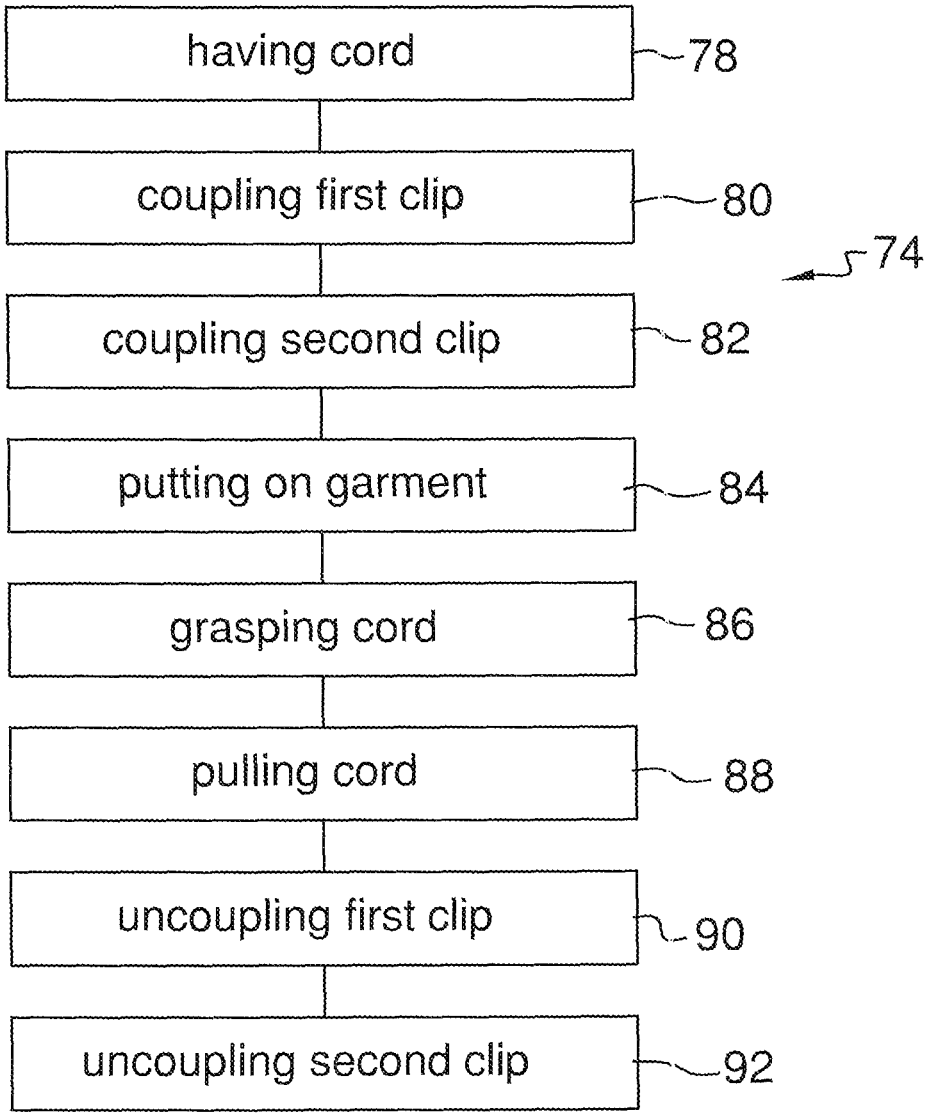
FIG. 6 is a schematic view of a method according to an embodiment of the disclosure.

In use, the device 10 allows for a method 74 of manipulating the slide fastener 36 on a back 76 of the garment 20. The steps of the method 74 as shown generally in FIG. 6. A first step 78 is having the cord 12 as described above. Another step 80 is coupling the first clip 18 to the garment 20 in a position such that the cord 12 is reachable by the person 22 wearing the garment 20. Yet another step 82 is coupling the second clip 30 to the slide fastener 36 on the slider 34. An additional step 84 is putting on the garment 20. Still yet another step 86 is grasping the cord 12. Another step 88 is pulling the cord 12 such that the cord 12 urges the slide fastener 36 into a closed position. Yet still another step 90 is uncoupling the first clip 18 from the garment 20 and another step 92 is uncoupling the second clip 30 from the garment 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A slide fastener extension tether device comprising:

a cord having a first end and a second end;

a first clip coupled to said first end of said cord, said clip being configured for coupling to a garment in a position reachable by a person wearing the garment;

a second clip coupled to said second end of said cord, said second clip having a pair of biased jaws wherein said second clip is configured for engaging a slider of a slide fastener such that pulling on said cord urges the slider to move along opposed sides the slide fastener wherein the slide fastener is selectively openable and closable by manipulation of said cord;

a stem extending from a distal end of a first one of said biased jaws of said second clip relative to said cord, said stem extending towards a second one of said biased jaws of said second clip wherein said stem is configured for insertion through an aperture in the slider wherein said second clip is engaged to the slider;

a plurality of opposed teeth coupled to said pair of biased jaws of said second clip; and said stem overlapping an inward face of a distal one of said teeth relative to said cord when said biased pair of jaws of said second clip are in a closed position.

2. The device of claim 1, further comprising a pair of grips, each of said grips being coupled to an associated one of a pair of tabs extending rearwardly from said pair of biased jaws of said second clip.

3. The device of claim 2, further comprising each of said grips being substantially disc-shaped.

4. The device of claim 1, further comprising a swivel coupled between said second end of said cord and said second clip.

5. The device of claim 4, further comprising:

a connector coupled to and extending from said second clip, said connector having a straight channel extending laterally relative to said second clip; and said swivel being substantially triangular having a straight side extending through said channel of said connector, said swivel having a point opposite said straight side extending through said channel, said point being coupled to a loop positioned at said second end of said cord.

6. The device of claim 1, further comprising said second clip being constructed of metal.

7. The device of claim 1, further comprising said first clip being constructed of plastic.

8. The device of claim 1, further comprising said first clip having a pair of biased jaws, said biased jaws of said first clip having smooth opposed surfaces.

9. A slide fastener extension tether device comprising:

a cord having a first end and a second end;

a first clip constructed of plastic, said first clip being coupled to said first end of said cord, said clip being configured for coupling to a garment in a position reachable by a person wearing the garment, said first clip having a pair of biased jaws, said biased jaws of said first clip having smooth opposed surfaces;

a second clip constructed of metal, said second clip being coupled to said second end of said cord, said second clip having a pair of biased jaws wherein said second clip is configured for engaging a slider of a slide fastener such that pulling on said cord urges the slider to move along opposed sides the slide fastener wherein the slide fastener is selectively openable and closable by manipulation of said cord;

a stem extending from a distal end of a first one of said biased jaws of said second clip relative to said cord, said stem extending towards a second one of said biased jaws of said second clip wherein said stem is configured for insertion through an aperture in the slider wherein said second clip is engaged to the slider;

a plurality of opposed teeth coupled to said pair of biased jaws of said second clip, said stem overlapping an inward face of a distal one of said teeth relative to said cord when said biased pair of jaws of said second clip are in a closed position;

a pair of grips, each of said grips being coupled to an associated one of a pair of tabs extending rearwardly from said pair of biased jaws of said second clip, each of said grips being substantially disc-shaped;

a connector coupled to and extending from said second clip, said connector having a straight channel extending laterally relative to said second clip; and a swivel coupled between said second end of said cord and said second clip, said swivel being substantially triangular having a straight side extending through said channel of said connector, said swivel having a point opposite said straight side extending through said channel, said point being coupled to a loop positioned at said second end of said cord.

* * * * *